US007717798B2

(12) United States Patent
Bellows et al.

(10) Patent No.: US 7,717,798 B2
(45) Date of Patent: May 18, 2010

(54) CHILD MOTION DEVICE

(75) Inventors: William B. Bellows, Wyomissing, PA (US); Dennis Stauffer, Birdsboro, PA (US)

(73) Assignee: Graco Children's Products Inc., Atlanta, GA (US)

( * ) Notice: Subject to any disclaimer, the term of this patent is extended or adjusted under 35 U.S.C. 154(b) by 847 days.

(21) Appl. No.: 11/556,485

(22) Filed: Nov. 3, 2006

(65) Prior Publication Data

US 2007/0120404 A1 May 31, 2007

Related U.S. Application Data

(60) Provisional application No. 60/732,640, filed on Nov. 3, 2005.

(51) Int. Cl.
*A63G 1/24* (2006.01)
*A63G 1/00* (2006.01)

(52) U.S. Cl. ..... 472/36; 472/43

(58) Field of Classification Search ..... 472/3, 472/36, 43, 44, 135; 104/53, 139
See application file for complete search history.

(56) References Cited

U.S. PATENT DOCUMENTS

| | | | | |
|---|---|---|---|---|
| 43,972 | A | | 8/1864 | Coldwell |
| 100,083 | A | | 2/1870 | Stephan |
| 616,697 | A | | 12/1898 | Cowles et al. |
| 1,360,495 | A | | 11/1920 | Bugenhagen |
| 1,439,478 | A | * | 12/1922 | Maynes ..... 472/37 |
| 1,707,167 | A | | 3/1929 | Marshall |
| 1,731,658 | A | | 10/1929 | Gnuechtel |
| 1,874,345 | A | | 8/1932 | Parrott |
| 2,371,384 | A | | 3/1945 | Dyer, Jr. |
| 2,506,890 | A | | 5/1950 | Pratt |
| 2,510,223 | A | | 6/1950 | Hart |
| 2,616,485 | A | | 11/1952 | Robbins |
| 2,704,111 | A | | 3/1955 | Wunderlich |
| 3,147,972 | A | | 9/1964 | Borsuk |
| 3,391,932 | A | | 7/1968 | Scalf |
| 3,829,086 | A | | 8/1974 | Lelong |
| 4,155,548 | A | | 5/1979 | Smith et al. |
| 4,226,467 | A | | 10/1980 | Boudreau |

(Continued)

FOREIGN PATENT DOCUMENTS

DE 2421474 11/1975

(Continued)

OTHER PUBLICATIONS

Fisher-Price Nature's Touch Baby Papasan Cradle Swing, Product # G2609, 2006; 2 pages; www.fisher-price.com.

(Continued)

*Primary Examiner*—Kien T Nguyen
(74) *Attorney, Agent, or Firm*—Lempia Braidwood LLC

(57) ABSTRACT

A child motion device has a frame assembly configured to rest on a support surface. The frame assembly includes at least one track configured to slidably receive a child seat assembly. The track can extend in any desired direction and include a geometric profile so that as the seat assembly travels along the track, a desired motion profile is imparted onto the seat assembly and to the child seated therein.

22 Claims, 8 Drawing Sheets

U.S. PATENT DOCUMENTS

| | | | | |
|---|---|---|---|---|
| 4,258,446 | A | 3/1981 | McAllister | |
| 4,620,334 | A | 11/1986 | Robinson | |
| 4,805,902 | A | 2/1989 | Casagrande | |
| 4,911,499 | A | 3/1990 | Meeker | |
| 5,303,433 | A | 4/1994 | Jang | |
| 5,403,239 | A | 4/1995 | Zimmers | |
| 5,451,093 | A | 9/1995 | Petrie et al. | |
| 5,463,961 | A * | 11/1995 | Graves | 104/53 |
| 5,685,778 | A * | 11/1997 | Sheldon et al. | 472/43 |
| 5,688,211 | A | 11/1997 | Myers | |
| 5,707,294 | A | 1/1998 | Fischer | |
| 5,803,817 | A | 9/1998 | Stern | |
| 5,833,545 | A | 11/1998 | Pinch et al. | |
| 5,935,012 | A * | 8/1999 | Cohn et al. | 472/43 |
| 6,027,409 | A | 2/2000 | Favorito et al. | |
| 6,254,490 | B1 | 7/2001 | Lawson et al. | |
| 6,318,803 | B1 | 11/2001 | Garland | |
| 6,343,994 | B1 | 2/2002 | Clarke | |
| 6,574,806 | B1 | 6/2003 | Maher | |
| 6,634,952 | B2 * | 10/2003 | Kroon et al. | 472/3 |
| 6,773,016 | B2 * | 8/2004 | Ochi | 273/448 |
| 6,811,217 | B2 | 11/2004 | Kane et al. | |
| 6,854,799 | B1 | 2/2005 | Asbach et al. | |
| 6,932,709 | B1 | 8/2005 | Gubitosi et al. | |
| 2002/0113469 | A1 | 8/2002 | Stern et al. | |
| 2005/0101219 | A1 | 5/2005 | Paesang et al. | |
| 2006/0012230 | A1 | 1/2006 | Kennedy | |
| 2007/0040431 | A1 | 2/2007 | Bapst et al. | |

FOREIGN PATENT DOCUMENTS

| | | |
|---|---|---|
| DE | 3834934 | 4/1990 |
| GB | 1 163 624 | 9/1969 |
| GB | 2 312 374 | 10/1997 |
| JP | 48068367 | 9/1973 |
| JP | 60014819 | 1/1985 |
| WO | WO 03/079861 | 10/2003 |
| WO | WO 2006/096712 | 9/2006 |

OTHER PUBLICATIONS

International Search Report and Written Opinion issued on Apr. 4, 2007 in related International Application No. PCT/US2006/060533.
English language translation of JP 48-68367.
English language translation of DE 2421474.

* cited by examiner

CHILD MOTION DEVICE

RELATED APPLICATION DATA

This claims the priority benefit of U.S. Provisional Patent Application Ser. No. 60/732,640 which was filed on Nov. 3, 2005, the contents of which are incorporated herein by reference.

BACKGROUND OF THE INVENTION

1. Field of the Disclosure

The present disclosure is generally directed to child motion devices, and more particularly to a device for supporting a child and imparting a soothing motion to the child.

2. Description of Related Art

Child motion devices such as conventional pendulum swings and bouncers are known in the art. These types of devices are often used to entertain and, sometimes more importantly, to sooth or calm a child. A child is typically placed in a seat of the device and then the device is used to swing the child in a reciprocating pendulum motion. In the case of a bouncer, a child is placed in the seat and vertical oscillating movement of the child results from the child's own movement or external force applied to the seat by someone else such as a parent.

Research has shown that many babies or children are not soothed or calmed down by these types of motion, but that these same children may be more readily calmed or soothed by motion imparted by a parent or adult holding the child. Parents often hold their children in their arms and in front of their torso and move in a manner that is calming and/or soothing to the child. Such movements can include side-to-side rocking, light bouncing up and down, or light rotational swinging as the parent either swings their arms back and forth, rotates their torso from side-to-side, or moves in a manner combining these motions.

Many types of child motion devices do not typically provide multiple different optional seating positions and arrangements for the child or multiple optional motion characteristics. A typical child motion device has only a single seating orientation and a single motion characteristic that can be provided for a child placed in the seat. A number of these types of devices are motorized to impart automatic and continuous movement to the child seat. These devices typically mount the motor above the head of a child within the device. The motor can be a noisy nuisance for the child. Additionally, the drive takes up space above the seat, which can make it difficult for an adult to position a child in the device. Furthermore, these devices typically provide motion about a single pivot axis, thereby limiting the type of motion characteristic provided.

Other alternative motion devices are known as well. For example, U.S. Pat. No. 6,811,217 discloses a child seating device that can function as a rocker and has curved bottom rails so that the device can simulate a rocking chair. U.S. Pat. No. 4,911,499 discloses a motor driven rocker with a base and a seat that can be attached to the base. The base incorporates a drive system that can move the seat in a rocking chair-type motion. U.S. Pat. No. 4,805,902 discloses a complex apparatus in a pendulum-type swing. Its seat moves in a manner such that a component of its travel path includes a side-to-side arcuate path in a somewhat horizontal plane (see FIG. 9 of the patent). U.S. Pat. No. 6,343,994 discloses another child swing wherein the base is formed having a first stationary part and a second part that can be turned or rotated by a parent within the first part. The seat swings in a conventional pendulum-like manner about a horizontal axis and a parent can rotate the device within the stationary base part to change the view of the child seated in the seat.

What is therefore needed is a child motion device that provides a motion characteristic not achieved by conventional motion devices.

SUMMARY

In accordance with one aspect of the present invention, a child motion device is supported by a support surface. The device further includes at least one track that defines a travel path. A seat assembly is movably supported on the track and reciprocally moves along the travel path. In accordance with another aspect of the invention, the travel path imparts at least one of a rocking motion, a gliding motion, and a bumping motion onto the seat assembly.

It should be appreciated that the foregoing and other aspects of the invention will appear from the following description. In the description, reference is made to the accompanying drawings which form a part thereof, and in which there is shown by way of illustration, and not limitation, preferred embodiments of the invention. Such embodiments do not necessarily represent the full scope of the invention, and reference must therefore be made to the claims herein for interpreting the full scope of the invention.

BRIEF DESCRIPTION OF THE DRAWINGS

Objects, features, and advantages of the present invention will become apparent upon reading the following description in conjunction with the drawing figures in which like reference numerals are intended to represent like elements throughout, and in which.

DETAILED DESCRIPTION OF THE DISCLOSURE

A number of examples are disclosed herein of alternative motion devices for soothing, calming, and/or entertaining children. The disclosed child motion devices solve or improve upon one or more of the problems or difficulties noted above with respect to known motion devices. The disclosed alternative motion devices each generally include a frame assembly having a seat holder that is configured to accept a seat or other child carrying device from another product, such as a car seat. The frame assembly further includes a track that provides a travel path for a supported child seat or other child carrying or supporting device. In the disclosed examples, the track can assume one of several alternative geometric configurations, and the seat can be electrically powered to ride along the travel path.

The travel path can be substantially flat such that the child seat translates in a pure side-to-side gliding motion, or the travel path can be contoured such that the elevation of the child seat changes to simulate a rocking motion and/or a bouncing motion in combination with the side-to-side motion. Additionally still the child seat can recline relative to the travel path to provide yet a third motion characteristic. In this way, a child seated in the seat can experience a variety of different motions. In another example, the seat can be automatically translated back and forth in a reciprocating manner along the track under the power of an electric motor.

The terms generally, substantially, and the like as applied herein with respect to vertical or horizontal orientations of various components are intended to mean that the components have a primarily vertical or horizontal orientation, but need not be precisely vertical or horizontal in orientation. The components can be angled to vertical or horizontal, but not to a degree where they are more than 45 degrees away from the reference mentioned. In many instances, the terms "generally" and "substantially" are intended to permit some permissible offset, or even to imply some intended offset, from the reference to which these types of modifiers are applied herein.

Figure 1:
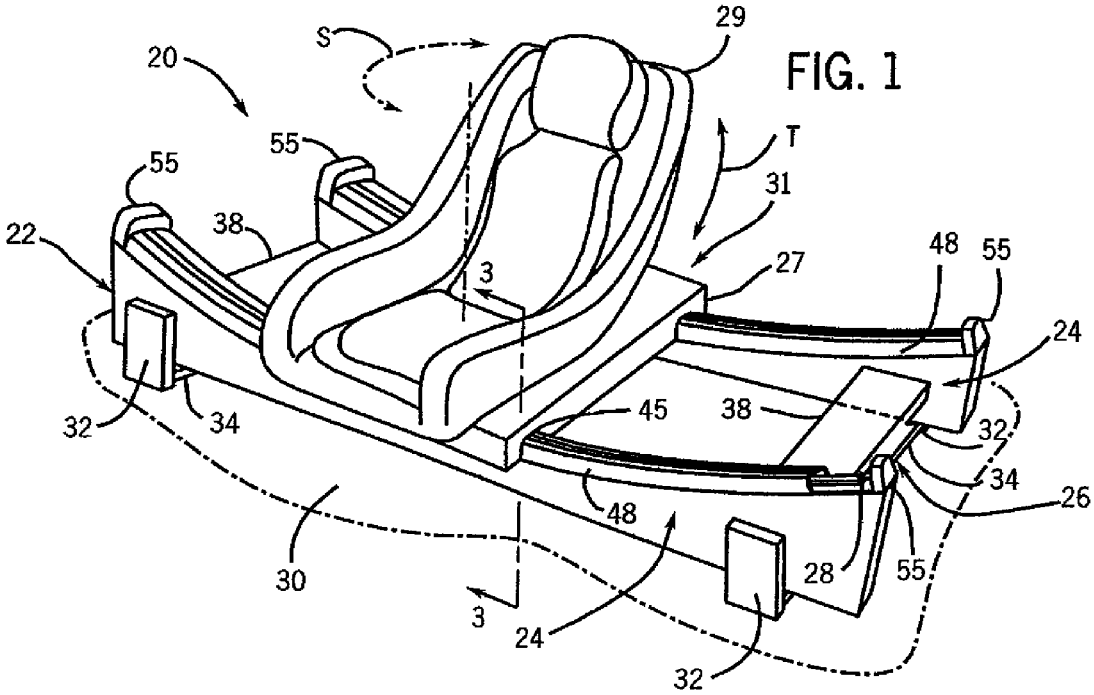
FIG. 1 is a perspective view of a child motion device constructed in accordance with one embodiment of the present invention.

Turning now to the drawings, FIG. 1 shows one example of a child motion device 20 constructed in accordance with the teachings of the present invention. The device 20 in this example generally includes a freestanding frame assembly 22 including a pair of longitudinally extending parallel tracks 24 that are supported by a base section 26. Each track 24 includes a corresponding rail 28, and a seat assembly 31 including a seat platform 27 that carries a child seat 29 is configured to ride along the track 24, guided by the rail 28, under the power of a drive assembly 50. In FIG. 1, a portion of the track 24 has been removed so that the rail 28 is visible. The base section 26 is configured to rest on a support surface 30 which can include both a surface on which the device rests when in the in-use configurations and a reference plane for comparison to other aspects and parts of the invention for ease of description.

The support surface 30 could comprise a tabletop, countertop, or other like surface depending upon, for instance, the height of the base section 26. However, the invention is not intended to be limited to use with only a specifically horizontal orientation of either the base section 26 of its frame assembly 22 or the reference plane. For instance, instead of the child motion device 20 being supported by an underlying support surface 30, the device could instead be cantilevered from a vertically extending support structure (not shown). Accordingly, the term "support surface" as used herein refers to any structure or surface capable of reliably supporting the child motion device 20 in a desired position and/or orientation. It should thus be appreciated that the support surface 30 and the reference plane are utilized to assist in describing relationships between the various components of the device 20.

The components of the base section 26 are described herein with reference to their position while in the in-use configuration and lying in floor reference plane. In this example, the base portion 26 includes a plurality of legs 32 (four legs as illustrated) or any alternative suitable structure that supports the child motion device 20 on the support surface 30. In the illustrated embodiment, laterally spaced legs 32 are connected by a support beam 34 extending laterally between, and connected to, the lower ends of the legs 32 at a location below the lower surface of the tracks 24. The support beams 34 provide enhanced support and structural integrity to the base section 26. Alternatively, or additionally, longitudinally extending support beams (not shown) can be provided and connected between longitudinally spaced legs.

Feet 36 are provided at the lower edges of the legs 32, and are configured to rest on the support surface 30. The feet 36 can comprise a structure, such as a disc or stopper, formed from an elastomeric or other like material that increases the frictional forces with respect to the support surface 30. The support beams 34 can be offset from the feet 34 such that they extend above the support surface 30 and below the tracks 24, or they can be substantially aligned with the feet 34 and can include aligned discs or stoppers (not shown) that engage the support surface 30.

A pair of stabilizing spacer members 38 can be further provided to enhance the stability of the device 20 and to maintain a consistent predetermined distance between the parallel tracks 24. As illustrated, a pair of laterally extending spacer members 38 is rigidly connected to the laterally inner surfaces of the opposing tracks 24 at locations proximal the legs 32.

The legs 32 extend vertically up from their feet 36 to an upper end that is connected to the frame assembly 22. Specifically, the laterally inner surface of the upper end of each leg 32 is connected to the laterally outer surface of the respective tracks 24. As illustrated, four legs 32 are connected at the four longitudinally outer ends of the tracks 24, but one having ordinary skill in the art will appreciate that the legs 32 can be connected to the tracks 24, either directly or indirectly, at any desired location to provide structural support and stability to the child motion device 20. Furthermore, while four legs 32are shown as being provided, it should be appreciated that a greater or fewer number of legs 32 can be provided as desired. The legs 32 can also flare longitudinally and/or laterally inward from their lower ends as they extend upwardly towards the tracks 24 to provide enhanced stability.

Figure 2:
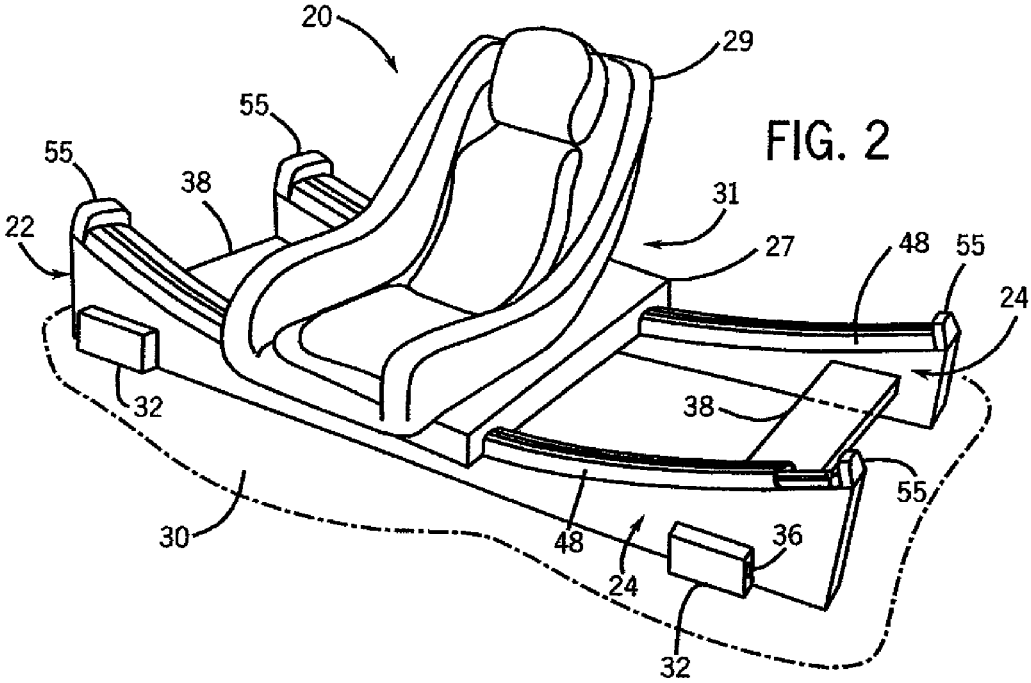
FIG. 2 is a perspective view of the child motion device illustrated in FIG. 1, but in a collapsed configuration.

The legs 32 can be pivotally connected to the tracks 24 in order to move the child motion device 20 between the set-up condition such as that illustrated in FIG. 1 and a folded or collapsed condition such as that shown in FIG. 2. Specifically, the support beams 34 can be eliminated or removable to allow the device to be folded for storage by pivoting the legs 32 to a longitudinally extending position along the tracks 24. The legs 32 can likewise be pivoted to the position shown in FIG. 1 when it is desired to use the device 20. The child motion device 20 has a very thin profile in its folded configuration, particularly when the child seat 29 is removed, which permits the device 20 to be easily stored in relatively small, thin spaces.

Alternatively, the legs 32 can be rigidly connected to the tracks 24 such that the child motion device 20 disclosed is not foldable at all. Instead, the child motion device 20 can be constructed so that it can not be collapsed without disassembly of the components. Quick disconnect joints can thus be employed so that the device 20 can be easily broken down for transport or storage.

Alternatively still, the legs 32 can be eliminated and that the lower edges of the tracks 24 can comprise be straight or contoured in a desired manner such that the tracks 24 are configured to rest directly on the support surface 30. In this arrangement, the stabilization members 38 can remain connected to the tracks 24 but do not extend below the tracks 24 so as to enable the tracks 24 to directly engage the support surface 30. In accordance with another alternative embodiment, if the legs 32 are eliminated, the stabilization members 38 can extend below the tracks 24 a sufficient distance so as to rest on the support surface 30.

Figure 3:
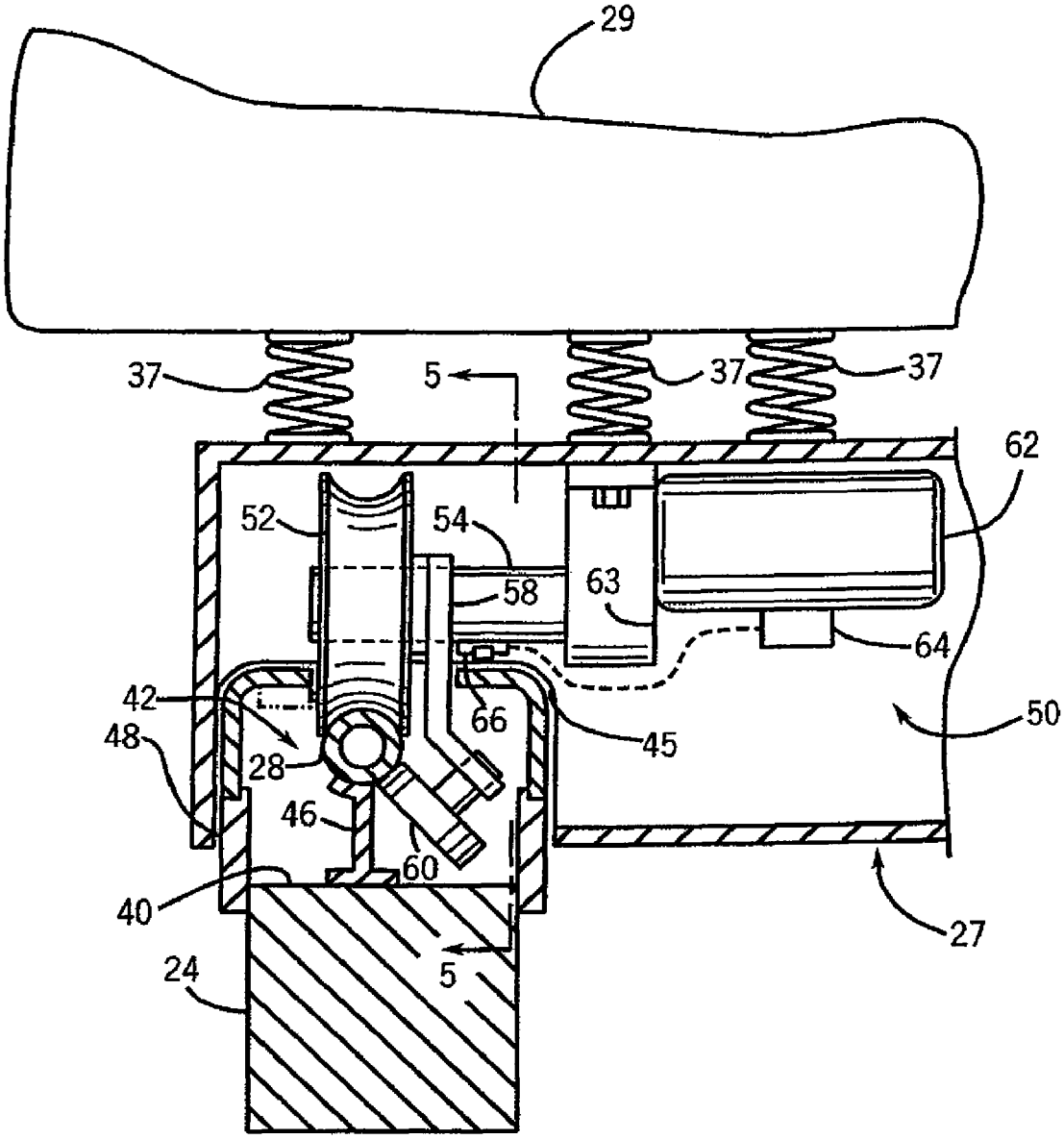
FIG. 3 is a sectional side elevation view of the child motion device taken along line 3-3 of FIG. 1.
Figure 4:
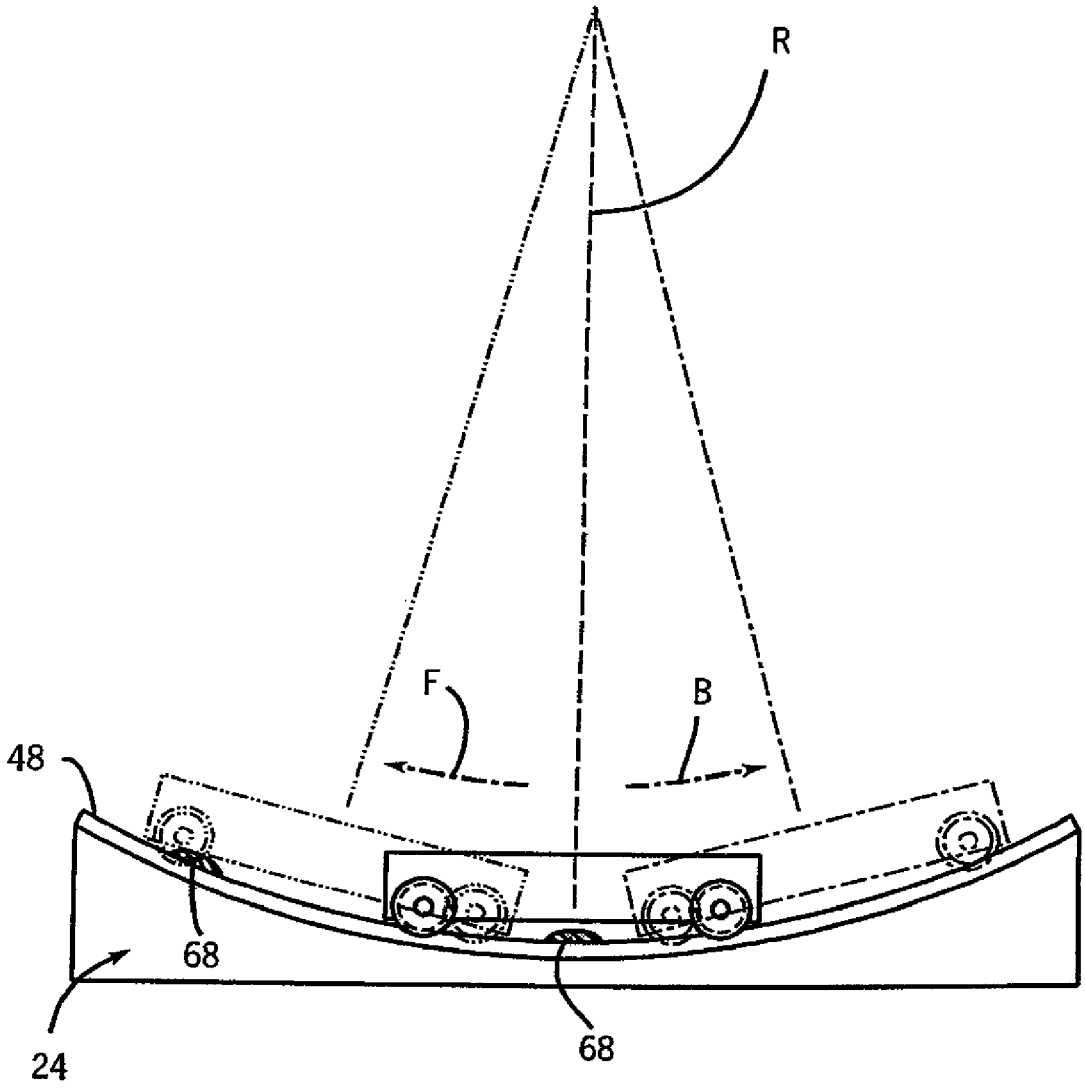
FIG. 4 is a side elevation view showing the child motion device during operation.

Turning now FIGS. 1 and 3-4, each track 24 has a height and a lateral width that are sufficient to ensure reliable attachment to the base section 26 and further to ensure structural stability and integrity during operation as child seat rides along the tracks 24. The precise dimensions of the tracks 24 and other structure of the child motion device 20 can be configured as desired based on, for instance, the dimensions of the seat platform 27 and the rated load weight for the device 20.

The tracks 24 each define corresponding upper surfaces 40 that are in substantial vertical alignment with each other along the length of the tracks 24 to define a path of motion for the seat platform 27 and the connected child seat 29. As shown in FIGS. 1 and 4, the tracks 24 define an actuate path along a plane that defines an angle that is greater than 0°, and substantially perpendicular, to the support surface 30. The arcuate path is defined by a radius R. The arcuate shape is configured such that the longitudinal outer ends of the tracks 24 are both disposed above a centrally disposed midpoint that defines the lowest point along the tracks 24 such that the longitudinal outer ends of the tracks 24 are spaced further from the support surface than the midpoints of the tracks 24. Each track 24 can therefore be substantially symmetrical about its longitudinal midpoint.

Accordingly, during operation, the seat platform 27 travels back and forth along the tracks 24 between the longitudinally outer ends of the tracks 24. The motion thus imparted onto the seat platform 27 (and therefore also the seat 29) simulates a pendulum having a radius substantially equal to the radius R that defines the arcuate shape of the tracks 24. The child motion device depicted generally in FIGS. 1-4 is thus constructed to simulate or mimic various movements that might be employed by a mother or father as they hold a child in their arms. For instance, the pendulum motion simulates an adult holding a child while alternately raising and lowering his/her shoulders or pivoting his/her torso from side-to-side to provide a rocking movement.

Referring now to FIG. 3, the seat assembly 31 can include one or more spring members 37 that extend vertically between the seat platform 27 and the seat 29. The spring members 37 can be traditional coil springs or any alternative structure having a desired spring constant that allow the child seat 29 to travel vertically (or bounce) during operation of the device 20. For instance, the child seat 29 can bounce due to the gravitational and inertial forces acting on the child seat assembly 31 due to the motion during operation of the device 20. Alternatively, a child's motion or a parent's touch can impart a mechanical bouncing motion. While spring members 37 have been illustrated and described as forming part of the seat assembly 31, it should be appreciated that the spring members 37 could be eliminated such that the child seat 29 is mounted directly to the seat platform 27.

With continuing reference to FIG. 3, the rail 28 will be described with respect to one of the tracks 24, it being appreciated that the description is equally applicable to the other track. In the illustrated embodiment, a support beam 46 extends along the length of the track 24, projects vertically from the upper surface 40 of the track 24, and connects at its upper end to the rail 28. The rail 28 is illustrated as a longitudinally elongated tubular member, but could alternatively assume any suitable size and shape appreciated by one having ordinary skill in the art.

A guard 48 extends along the track and protects the rail from debris. The guard 48 includes a pair of L-shaped walls that are connected at their lower ends to the upper end of the lateral outer surfaces of the track 24 and that extend laterally inwardly at a location above the rail 28. A gap exists in the upper surface of the guard 48 to accommodate a wheel 52 of the seat platform 27. A tie 55 (see FIG. 1) surrounds the walls of the guard 48 at the longitudinally outer end of the guard to provide enhanced structural stability. The guard 48 can be formed from a rigid plastic or any alternative material suitable to substantially maintain its shape over time to provide protection to the rail without impinging on the wheel 52. The bottom surface of the seat platform 27 defines a pair of laterally spaced elongated inverted U-shaped grooves 45 (see also FIG. 9) that are configured to receive, and fit around, the guards 48 free from interference.

With continuing reference to FIG. 3, the child motion device 20 includes a drive assembly 50 that is configured to cause the seat assembly 31 to automatically travel back and forth along the tracks 24 at a predetermined speed. The drive assembly 50 includes a relative motion assembly 42 that maintains the seat platform 27 in reliable sliding engagement with the tracks 24. In the embodiment illustrated in FIG. 3, the motion assembly 42 includes four similarly constructed wheels 52 have a curvature configured to mate with the curvature of the rail 28, which thus provides a mating contact surface for the wheels. At least one of the wheels 52 (shown in FIG. 3) is driven by the drive assembly 50, while the remaining wheels 52 can passively rotate along the tracks 24. The illustrated wheel 52 is supported on a cylindrical housing 54 that contains a driven shaft 56 (see FIG. 5). A bracket 58 extends vertically down from the housing 54 and into the guard 48, at which point the bracket 58 flares laterally outward and rotatably supports a capture wheel 60 that is configured to ride along the track at a location adjacent the support beam 46. The rail 28 is thereby trapped between the wheels 52 and 60, thereby preventing the seat platform 27 from becoming derailed during operation. It should be appreciated that the capture wheel 60 can be eliminated and that reliable contact between the wheels 52 and the rail 28 can be maintained under gravitational forces.

Still referring to FIG. 3, the drive assembly 50 further includes an actuator in the form of a motor 62 that receives command signals from a controller 64. The motor 60 can receive power from any known source, such as a battery or a conventional electrical receptacle. The motor drives the shaft 56 to rotate via a gearbox 63 that can include a conventional clutch assembly (not shown). The driven shaft 56 is enclosed in the housing 54 that supports the capture wheel support bracket 58 as described above. Also supported on the housing 54 is a normally open limit switch 66 that includes a downwardly facing actuator extending through an opening in the bottom wall of the seat platform 27 at the groove 45 and immediately adjacent the wheel 52.

Figure 5:
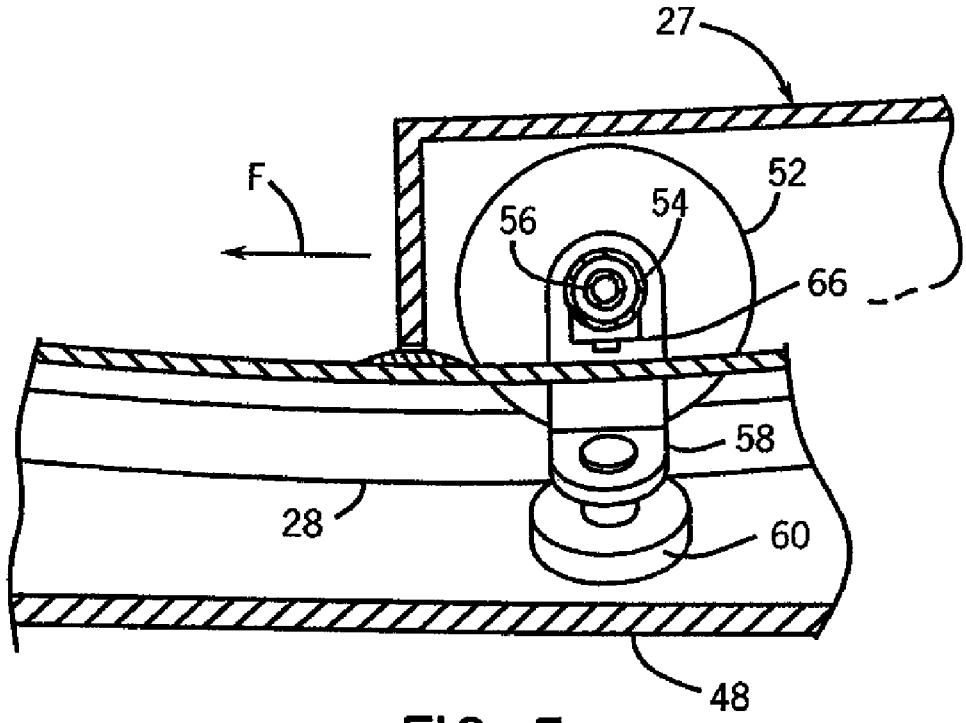
FIG. 5 is a sectional side elevation view of the child motion device taken along line 5-5 of FIG. 3.
Figure 6:
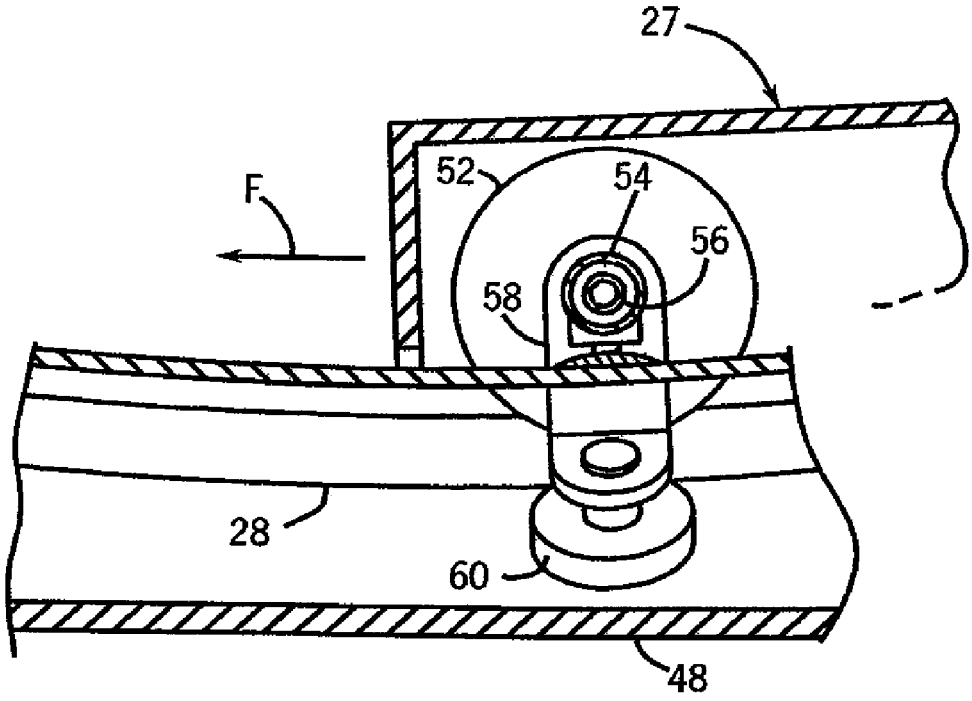
FIG. 6 is a sectional side elevation view similar to that of FIG. 5 but showing control circuitry elements in an actuated position.

As illustrated in FIGS. 4-6, two cam surfaces 68 are mounted onto the upper surface of the guard 48 at a location immediately adjacent the wheel 52 and laterally aligned with the actuator of the limit switch 66. The cam surfaces 68 have a height that is sufficient to depress the actuator of the limit switch 66, but low enough to provide clearance relative to the bottom edge of the seat platform 27. As illustrated in FIG. 5, as the seat platform 27 travels in a forward direction as illustrated by Arrow F, the actuator of the limit switch 66 is not depressed and the controller continues the mode of motor operation. However as the seat platform 27 travels over the cam surface 68, the limit switch actuator becomes depressed, thereby sending a signal to the controller 64 indicating the position of the seat platform 27.

The operation of the child motion device 20 will now be described with reference to FIG. 4. First, the user can mount the child seat 29 onto the child seat platform 27 to provide a seat assembly 3 1. Advantageously, seat 29 can be configured to mate within a platform or system of related products. In other words, the seat could be removable from one of the disclosed motion devices and readily placed in a different product that is configured to accept the seat. Such related products can be, for example, a cradle swing frame, a standard pendulum-type swing frame, a bouncer frame, a stroller, a car seat base, or an entertainment platform. In this way, the product system can be useful as a soothing or calming device when a child is young then be transformed for use as an entertainment device.

It should be appreciated, however, that the seat assembly 31 need not include both the seat platform 27 and the child seat 29, nor need the seat assembly 31 be limited to only the seat platform 27 and the child seat 29. For instance, the seat 29 can include the grooves 45 that accommodate the rails 28 and can further include the motion assembly 42 and drive assembly 50, thereby dispensing with the seat platform. Alternatively, a third member could be provided that houses the drive assembly 50, thereby removing the drive assembly 50 from the seat platform. Accordingly, the term "seat assembly" is used herein to describe any apparatus that allows a child seat to travel along at least one track in accordance with at least one aspect of the present invention.

Once the seat assembly 31 is mounted to the tracks 24 and the child is secured in the seat 29, the child motion device 20 can be powered on to cause the seat assembly 31 to translate back and forth along the tracks 24. Specifically, the controller 64 causes the motor 62 to drive one of the wheels 52, thereby causing the wheels 52 and 60 to propel the seat assembly 31 in the forward direction at a desired speed consistent with a soothing rocking motion. A cam surface 68 is disposed on the track 24 at a location proximal the forward-most end of the track 24. Accordingly, when the limit switch 66 is depressed by the cam surface 68, the controller 64 either causes the motor 62 to stop rotating or disengages a clutch (not shown) that can be located inside, for instance, the gearbox 63. Accordingly, the seat assembly 31 travels back down the track 24 under gravitational forces.

A second cam surface 68 is disposed at the midpoint of the track 24 and engages the limit switch 66 as the seat assembly 31 travels back along the direction of Arrow B. The seat assembly 31 traveling rearwardly passes over the middle cam surface 68 and travels up along the track until the momentum of the seat assembly 31 is overcome by gravity, thus causing the assembly 31 to travel again in the forward direction F under gravitational forces. The seat assembly 31 will travel over the cam surface 68 a second time, at which point the controller 64 will actuate the motor to again drive the seat assembly 31 in the forward direction until the limit switch 66 is again engaged by the forward cam surface 68. The ties 55 extend vertically beyond the track 24, and thus provide bumpers disposed proximal the outer longitudinal ends of the track 24 as a safeguard to prevent the seat assembly from traveling off the track 24.

The seat assembly 31 will thus vary in positional height between a low elevation point and a high elevation point as it moves along the travel path. These elevations can be set to occur anywhere along the travel arc, depending upon where the mid-point of the travel arc of the seat assembly 31 is designed to occur. If the mid-point M of the travel arc is set at the lowest elevation of the travel plane defined by the seat holder travel arc (shown in FIG. 4), equal high points will occur at the opposite extreme longitudinal ends of the arc. This configuration may best simulate the motion that a child might experience when held in their parent's arms.

In accordance with the certain aspects of the present invention, the seat assembly 31 travels back and forth along the tracks at a frequency of no more than two minutes per cycle (i.e., no more than two minutes for the seat assembly 31 to travel from the neutral position to the forward most position, back through the neutral position to the rearward most position, and return to the neutral position). Certain aspects of the present invention contemplate that the device travel from one end of the track 24 to the other has a length that is no more than approximately 6 feet, or 72 inches.

While one example of a drive assembly has been described in accordance with certain aspects of the present invention, it should be appreciated that the present invention is not intended to be limited to the drive assembly 50 disclosed herein, and that several alternatives are contemplated by the present invention. For instance, the cam surfaces 68 and limit switch 66 could be replaced by, or provided in addition to, any known alternative position sensor in accordance with various aspects of the present invention. For example, a hall effect sensor could provide rotational position signals to the controller that allow the controller to calculate the position of the platform 27 based on a known diameter of the wheel 52 and a known starting location of the platform 27. In another embodiment, a capacitive feedback circuit can be employed having an interface that senses a change in capacitance as the wheel 52 rotates. The change in capacitance can trigger position signals to an integrated circuit, thus causing the controller 64 to drive the motor 62 as desired. Alternatively still, the relative motion assembly 42 could alternatively be configured with a translating glider that is connected to the seat assembly 31 to drive the seat assembly 31 back and forth along the tracks 24. Accordingly, unless otherwise noted, the term "drive assembly" is intended to encompass any suitable structure that causes the seat assembly 31 to travel repeatedly back and forth repeatedly along a predetermined path.

As described above, the child motion device 20 constructed in accordance with various aspects of the present invention can be constructed to simulate or mimic various movements that might be employed by a mother or father as they hold a child in their arms. Parents usually hold their child and move them in a slow, even rhythm to help calm or soothe the child. For instance, an adult may simply sway the child back and forth by laterally moving their elbows from side to side while holding the child, creating a relatively flat gliding motion for the child. Other times, the adult may repeatedly raise and lower the child to include a bumping motion along with the rocking or flat gliding motion.

Likewise, an adult can easily alter the position of the child held in their arms. Sometimes an adult may hold a child in a somewhat seated position with the child facing away from their chest. In another example, the child may be held in a position looking directly at the adult. In another example, the child may be held with their legs to one side and head to another side and rocked by the adult. The disclosed child motion devices can simulate any or all of these various proven, natural, calming and soothing movements.

Figure 7:
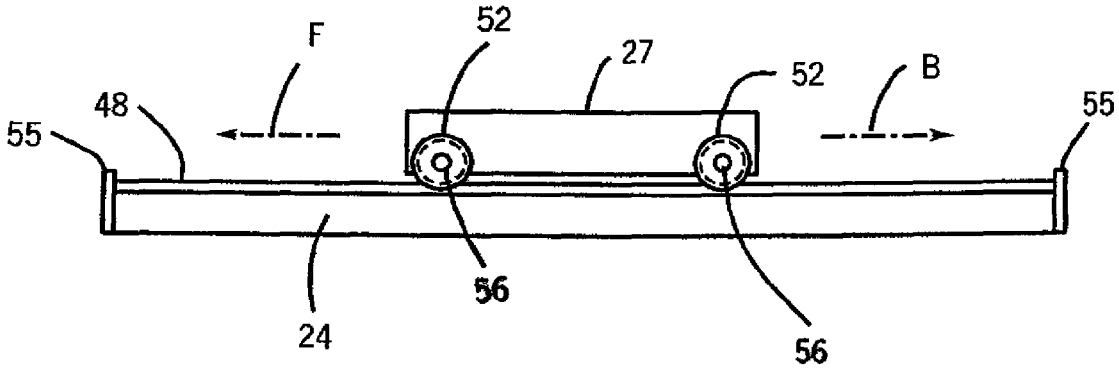
FIG. 7 is a side elevation view of a child motion device similar to that illustrated in FIG. 1 but including tracks constructed in accordance with an alternative embodiment.
Figure 8:
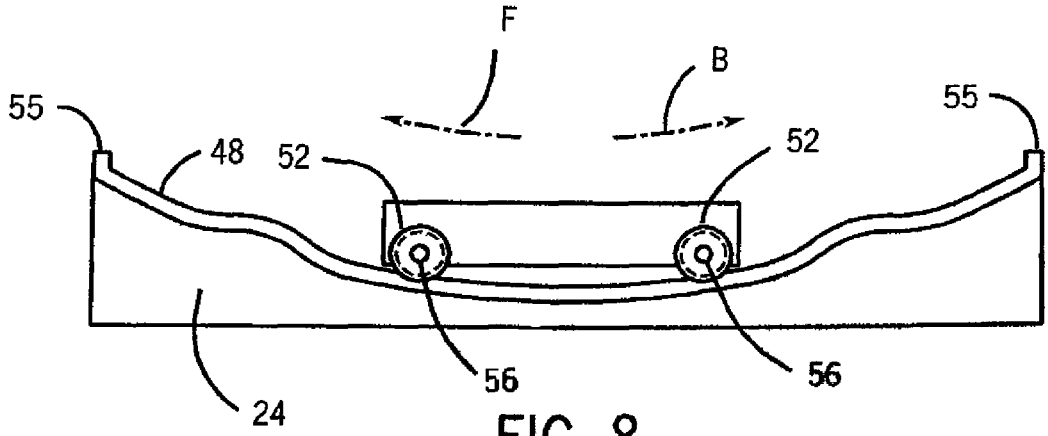
FIG. 8 is a side elevation view of a child motion device similar to that illustrated in FIG. 12 but including tracks constructed in accordance with another alternative embodiment.

For instance, while a pure rocking movement is simulated with the track construction illustrated in FIGS. 1-4, other types of motion are simulated using alternative track constructions. One having ordinary skill in the art will recognize that the tracks 24 can define virtually any suitable path of motion for the seat platform 27 and child seat 29. FIGS. 7 and 8 show alternative arrangements for the device 20 to product different motion characteristics.

As illustrated in FIG. 7, the tracks 24 are shown as having a child motion device 120 is illustrated having reference numerals corresponding to like elements of device 20 incremented by 100 for the purposes of clarity and convenience. As illustrated, the child motion device 120 includes tracks 24 whose rails define a substantially flat profile such that the elevation of the seat assembly 31 is substantially constant as it travels back and forth along the track 24 during operation. Accordingly, the seat assembly 31 assumes a side-to-side gliding motion. It should be appreciated that in the embodiment illustrated in FIG. 7, the controller would cause the motor 62 to drive the wheel in forward and backward directions to impart the reciprocating motion onto the seat assembly 31.

As illustrated in FIG. 8, the tracks 24 are shown as having the arcuate travel path as illustrated in FIG. 4. However, the tracks further include sections of elevation changes 57 that produce bumps in the travel path. Accordingly, as the seat assembly 31 travels back and forth along the tracks 24, bouncing or oscillating vertical motion is imparted onto the seat assembly 31 based on the contour of the track. The vertical motion is angular, and the angle of vertical motion is at least partially dependent upon the slope of the bumps 57 relative to the direction of the track 24 immediately adjacent the bump. If the momentum of the seat assembly 31 is insufficient to overcome the gravitational forces while traveling over the bumps 57 in the direction of rearward travel, the controller 64 can be configured to cause the motor 62 to drive the wheel 52 in the rearward direction as needed.

The various components of the child motion device 20 shown in FIG. 1 and the various alternative embodiments of child motion devices described herein can vary considerably and yet fall within the spirit and scope of the present invention. A small number of examples are disclosed to illustrate the nature and variety of component configurations.

For instance, while not illustrated herein, any number of a virtually infinite number of track configurations fall within the scope of the present invention. As one example, the rocking motion simulated by the child motion device illustrated in FIGS. 1 and 8 could be varied by altering the configuration of tracks 24 to induce a greater or lesser slope to the rocking motion. Furthermore, the track 24 could include more or fewer bumps than that illustrated in FIG. 8. In addition, the track 24s of FIGS. 1, 7 and/or its alternatives could include bumps as illustrated and described herein. Still furthermore, while various alternatives to the track 24 extended longitudinally, they could further have lateral directional components, thus imparting lateral curves in the direction of travel such that the travel path extends substantially parallel to the support surface 30. As an additional example, while a pair of tracks 24 has been illustrated in accordance with the various examples described herein, the present invention contemplates a uni-track configuration whereby a single track supports the seat assembly for motion along the single track. All such alternatives are contemplated by the present invention.

Figure 9:
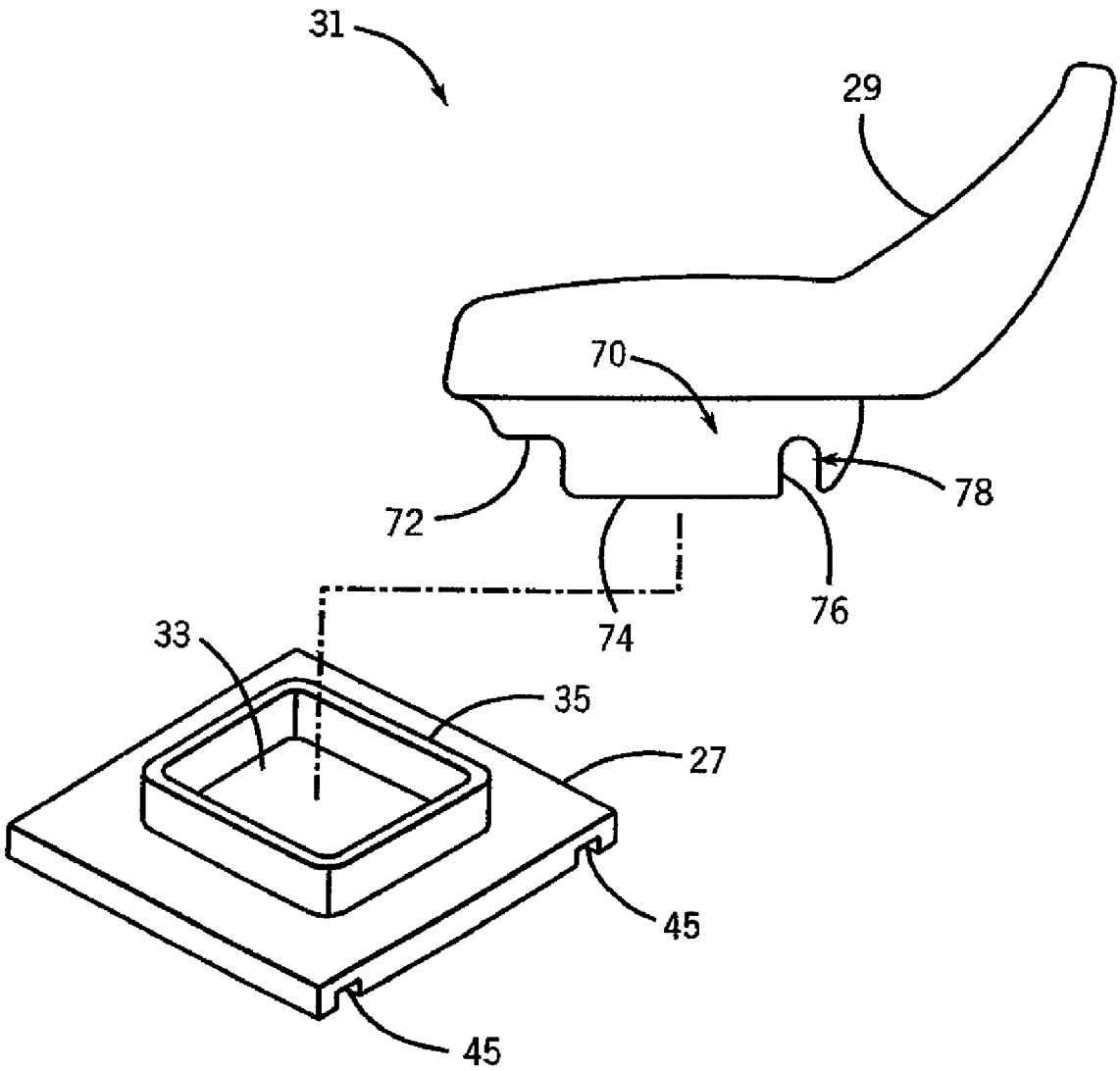
FIG. 9 is a perspective view of a seat assembly constructed in accordance with one embodiment of the present invention.
Figure 10:
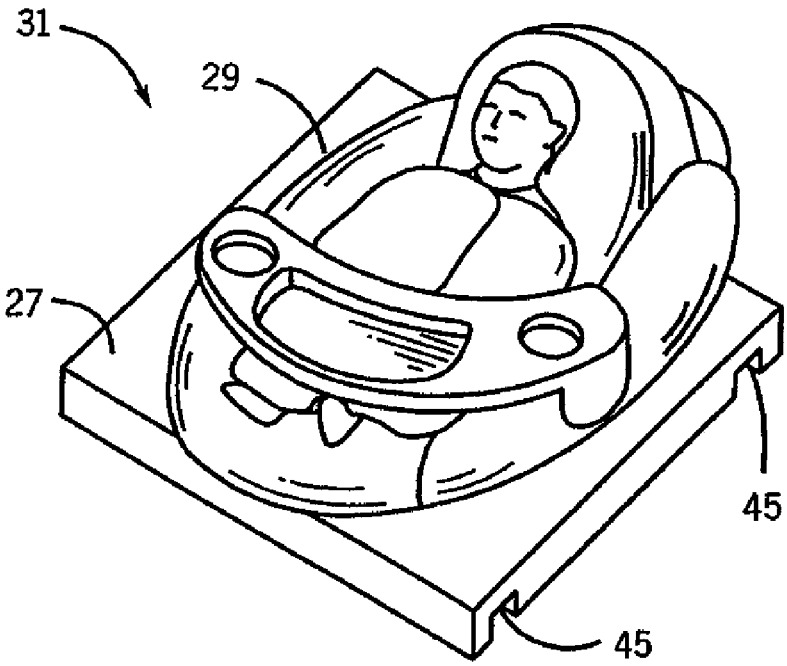
FIGS. 10-13 are perspective views of a seat platform illustrated in FIG. 7 and each showing a child seat mounted in a different one of a plurality of optional seating orientations.
Figure 11:
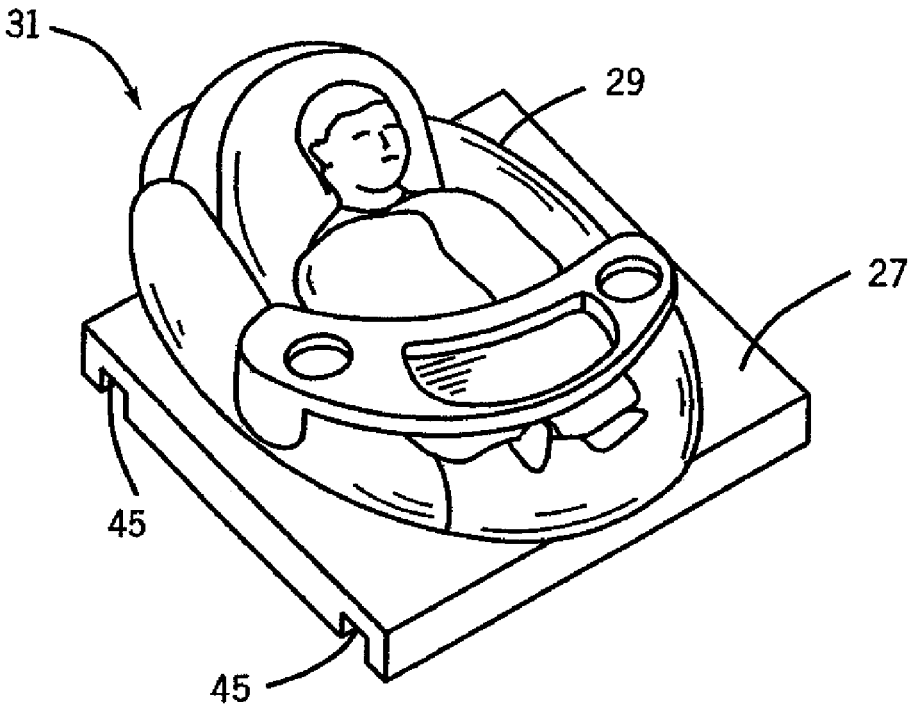
Figure 12:
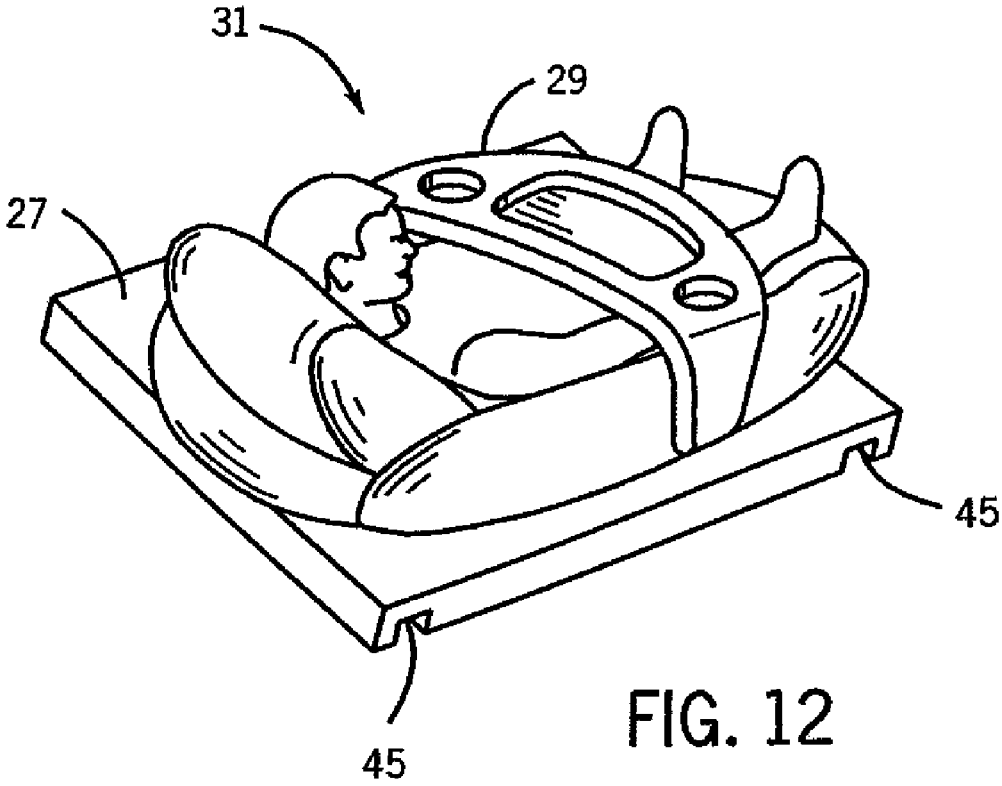
Figure 13:
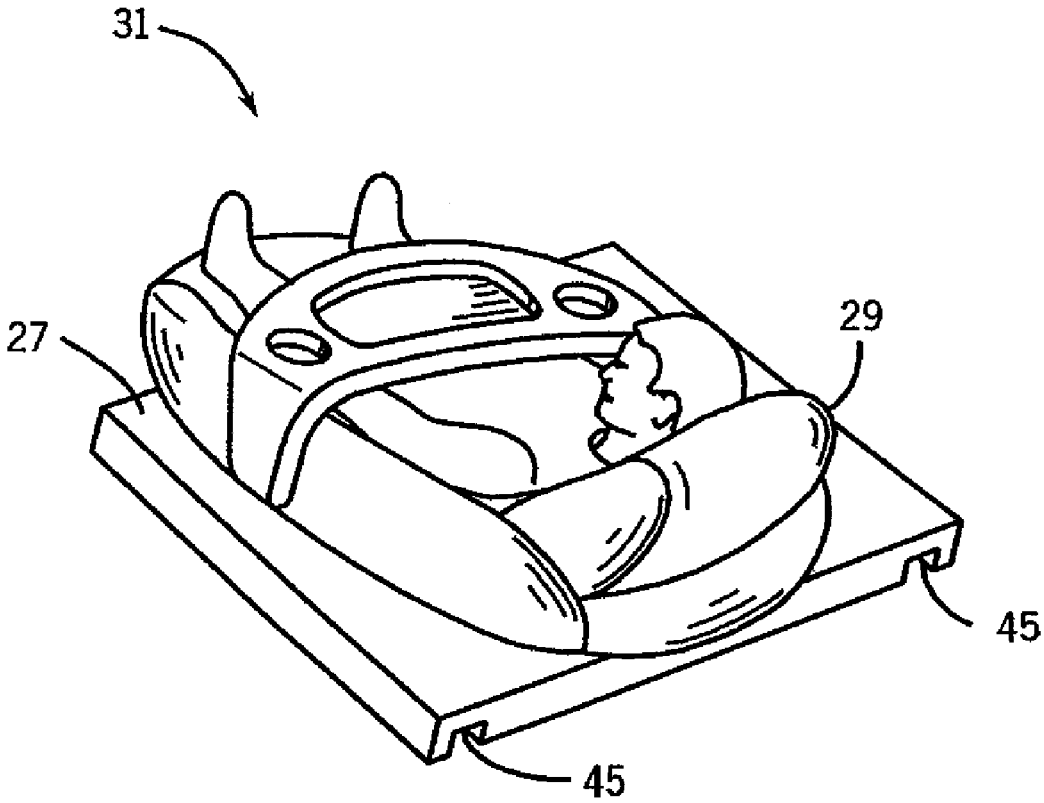

In one aspect of the invention, the seat holder 34 is configured to permit the child seat 36 to be mounted on the support arm 30 in a number of optional orientations. As illustrated in FIG. 9, the child seat 29 can have a contoured bottom or base 70 with features configured to engage with portions of the seat platform 27 so that when it is rested on the seat platform, the child seat 29 is securely held in place. In this example, the seat platform 27 includes a seat holder 35 formed of tubular, linear side segments. The seat bottom has a flat region 72 on one end that rests on one linear side segment of the holder 35. A depending region 74 of the seat base 70 is sized to fit within an opening 33 of the holder 35. The other end of the base 70 has one or more aligned notches 76 that are configured to receive the opposite linear side segment of the holder 35. The depending region 74 and the notches 76 hold the child seat 29 in place on the holder 35. Gravity alone can be relied upon to retain the seat in position. In another example, one or more positive manual or automatic latches 78 can be employed in part of the seat, at one or both ends of the seat, as part of the seat holder 35, and/or at one or both ends of the seat holder to securely hold the child seat 29 in place on the seat holder 35. The latches 78 can be spring biased to automatically engage when the seat is placed on the holder 35.

Geometry and symmetry can be designed into the holder 35 and seat 29 to permit the seat to be placed in the holder in multiple optional seat orientations. FIGS. 10-13 illustrate one example of an array of optional child seat orientations rotatably offset 90° relative to the seat platform 27. By placing the seat 29 in different orientations on the child motion device 20, the child can experience different relative motions and a variety of different visual environments.

The child seat 29 can thus be configured so that it engages with the seat platform 27 in any suitable manner. The seat can also be configured to include common features such as a harness system, carrying handles, a pivotable tray, and a hard plastic shell. The base of the seat can have a rocking, bouncing, or stationary support structure configuration and the seat can employ a pad, cover, or other suitable soft goods. As noted above, the seat holder can be configured to hold other devices such as a bassinet or other child supporting device.

Furthermore, in any of the examples disclosed herein, the seat 29 can swivel in the direction shown by Arrow S in FIG. 1, and oriented in virtually any rotational position on the seat platform 27 as desired. In fact, the seat platform 27 and/or the seat 29 can be cooperatively designed to permit the seat 29 or other child supporting device to be rotated between fewer than four, more than four, or even an infinite number of seat facing orientations when placed on the holder. Cooperating discs on the two parts could be employed to achieve infinite orientation adjustment. Alternatively, the seat platform 27 can be configured as a circular ring surrounding an open space, and the child seat 29 can have a bottom configured with vertical or angled slots that engage opposite sides of the ring. Furthermore, the seat assembly 31 can further be tilted or reclined forward or back in the direction of Arrow T of FIG. 1 using any known reclining mechanism appreciated by one having ordinary skill in the art.

Additional play or entertainment features can also be employed in the disclosed devices. Motion speed options, music and sound options, and other entertainment features can be configured as part of the device. These features can be electronically linked to occur as part of optional, selectable program settings or use modes. For example, a "soothing" setting could be programmed to pre-select music or background sound to accompany a use mode or other product features to create desired characteristics for that setting. Other optional settings can have their own pre-programmed or selectable features as well. Additionally, different play features associated with the devices can be employed in different ways, depending upon the selected child seat orientation. For example, an entertainment device, a toy, a video screen such as an LCD screen, or the like (not shown) can be mounted on or part of the frame assembly 22 or seat assembly 31 to entertain the child as he/she moves. Toys or other play features can also be provided as part of or attachable to the child seat 29, if desired.

The invention has been described in connection with what are presently considered to be the most practical and preferred embodiments. However, the present invention has been presented by way of illustration and is not intended to be limited to the disclosed embodiments.

For instance, while embodiments have been shown for supporting the rails 28 on the tracks 24 and for providing a child seat that is configured to automatically travel along the rails 28, it should be appreciated that the present is not intended to be limited to the embodiments illustrated and described herein, and that any alternative construction suitable to allow for reliable translation of a baby seat along a set of tracks is contemplated by the present invention. Furthermore, the details of the various child motion device examples disclosed herein can vary considerably and yet fall within the spirit and scope of the present invention. The construction and materials used to form any components of the device 20 can vary from plastics, to steel tubing, to other suitable materials and part structures.

Accordingly, those skilled in the art will realize that the invention is intended to encompass all modifications and alternative arrangements included within the spirit and scope of the invention, as set forth by the appended claims.

What is claimed is:

1. A child motion device supported by a support surface, the child motion device comprising:

at least one track defining a travel path and having an arcuate shape with longitudinal outer ends disposed above a midpoint that defines the lowest point along the track;

a seat assembly movably supported on the track; and a drive assembly propelling the seat assembly along the travel path in a reciprocating manner, wherein the seat assembly has a momentum and travels along at least a portion of the travel path under gravitational force, and wherein, when the momentum of the seat assembly is overcome by gravity, the seat assembly is driven along the track by the drive assembly.

2. The child motion device as recited in claim 1, wherein the track defines a rail having a contact surface configured to engage at least one wheel for rotation thereon.

3. The child motion device as recited in claim 2, wherein the drive assembly comprises at least one wheel supporting the seat assembly on the rail.

4. The child motion device as recited in claim 3, wherein the drive assembly comprises a drive that actuates the wheel to roll along the rail to move the seat assembly along the travel path.

5. The child motion device as recited in claim 1, wherein the drive assembly further comprises an actuator configured to drive the seat assembly along the travel path.

6. The child motion device as recited in claim 5, further comprising a position sensor and a controller sending control signals to the actuator based on an output from the position sensor.

7. The child motion device as recited in claim 1, wherein the travel path further comprises at least one bump to impart a bouncing motion onto the seat assembly.

8. The child motion device as recited in claim 1, further comprising a pair of the tracks extending substantially parallel to each other, wherein the tracks provide the travel path.

9. The child motion device as recited in claim 1, wherein the seat assembly comprises a removable seat.

10. The child motion device as recited in claim 1, wherein the seat assembly further comprises a seat holder configured to receive and support a child seat in more than one optionally selectable seat facing orientations.

11. The child motion device as recited in claim 10, wherein the child seat can rest on the seat holder in orientations offset substantially 90° from each other.

12. The child motion device as recited in claim 1, wherein the seat assembly comprises a removable seat configured to be readily secured for use in another device selected from a group consisting of a stroller, a pendulum swing, a bouncer, and a car seat.

13. The child motion device as recited in claim 1, further comprising a frame with a base section supporting the at least one track on the support surface.

14. The child motion device as recited in claim 13, wherein the base section is pivotally coupled to the frame and can be folded to a collapsed configuration.

15. The child motion device as recited in claim 1, wherein the seat assembly comprises a seat that can be adjustably reclined.

16. The child motion device as recited in claim 1, wherein the travel path from one end of the track to the other has a length no more than approximately 6 feet.

17. The child motion device as recited in claim 1, wherein the seat assembly travels along the travel path at a frequency of no more than two minutes per cycle.

18. A child motion device comprising:

a base assembly supported by a support surface;

at least one track supported by the base assembly, the track providing a surface that defines a travel path and having an arcuate shape with longitudinal outer ends disposed above a midpoint that defines the lowest point along the track;

a seat assembly supported by the track, and wherein a child seat of the seat assembly can be oriented in more than one optionally selectable seat facing orientation; and a drive assembly actuating the seat assembly to drive the seat assembly along the track, wherein the seat assembly reciprocates along the travel path.

19. The child motion device as recited in claim 18, wherein the travel path imparts at least one of a rocking motion, a bouncing motion, and a side-to-side gliding motion onto the seat assembly.

20. The child motion device as recited in claim 18, further comprising a pair of the tracks, wherein the drive assembly further comprises at least one wheel supporting the seat assembly on the pair of tracks, the wheel being rotatable on the track to drive the seat assembly along the track in a reciprocating manner.

21. The child motion device as recited in claim 20, wherein the seat assembly further comprises a seat holder configured to receive and support the child seat in more than one optionally selectable seat facing orientations.

22. The child motion device as recited in claim 21, wherein the child seat can rest on the seat holder in orientations offset substantially 90° from each other.

* * * * *